US005772052A

United States Patent [19]

Campbell

[11] Patent Number: 5,772,052

[45] Date of Patent: Jun. 30, 1998

[54] RACK FOR STORING MULTIPLE ROLLS OF MATERIAL AND FOR FACILITATING THE CUTTING OF A PORTION OF MATERIAL FROM THE ROLL

[76] Inventor: Bill W. Campbell, 1519 Ashwood Ave., Nashville, Tenn. 37212

[21] Appl. No.: 575,982

[22] Filed: Dec. 21, 1995

[51] Int. Cl.[6] ..... A47F 7/17

[52] U.S. Cl. ..... 211/44; 225/77

[58] Field of Search ..... 211/13, 44, 123; 225/77; D6/520; 242/553, 554.2, 554.3

[56] References Cited

U.S. PATENT DOCUMENTS

| | | | |
|---|---|---|---|
| D. 76,906 | 11/1928 | Victor | 211/44 X |
| D. 139,814 | 12/1944 | Anderson | 211/44 X |
| D. 224,864 | 10/1972 | Belz | D6/520 |
| D. 225,267 | 11/1972 | Roisman | D6/520 |
| D. 284,722 | 7/1986 | Beckerman | D6/520 |
| 384,626 | 6/1888 | Hilleary et al. | 211/44 X |
| 617,280 | 1/1899 | Chilton | 211/44 X |
| 640,187 | 1/1900 | Eley | 211/44 X |
| 681,745 | 9/1901 | Seawright | 225/77 |
| 842,090 | 1/1907 | Finan | 225/77 |
| 906,347 | 12/1908 | Willner | 211/44 X |
| 1,541,505 | 6/1925 | Hurley | 223/77 |
| 1,750,582 | 3/1930 | Elliott . | |
| 1,922,892 | 8/1933 | Holleman | 211/44 X |
| 2,349,635 | 5/1944 | Pusheck | 225/77 |
| 2,462,321 | 2/1949 | Holmes | 211/123 |
| 4,275,827 | 6/1981 | Cole | 225/77 |
| 4,755,254 | 7/1988 | Bedwell | 156/554 |
| 4,783,017 | 11/1988 | Ovitz et al. | 242/55 |
| 5,054,675 | 10/1991 | Taves | 225/77 X |
| 5,139,160 | 8/1992 | Romano | 211/44 |
| 5,143,230 | 9/1992 | LaCorte | D6/520 X |
| 5,261,619 | 11/1993 | Merriweather, Jr. | D6/520 X |
| 5,277,351 | 1/1994 | McCullagh | 225/77 X |
| 5,301,854 | 4/1994 | Scobey | 225/77 X |

OTHER PUBLICATIONS

Gel Saver, Backstage Equipment, Inc., 8010 Wheatland Ave., Unit D, Sun Valley, CA 91352, no date.

*Primary Examiner*—Ramon O. Ramirez
*Assistant Examiner*—Long Dinh Phan
*Attorney, Agent, or Firm*—Waddey & Patterson; Edward D. Lanquist, Jr.

[57] ABSTRACT

A rack for storing rolls of material and for facilitating the removal of a portion of material from the roll is described. The rack comprises a substantially rectangular frame comprising a top transverse member, a pair of substantially parallel vertical members, and a bottom transverse member; a number of paired sets of spindles mounting along the vertical members of the frame for mounting a number of rolls of material horizontally within the frame; a platform extending horizontally between the vertical members, the platform movably mounted to a front surface of the vertical members; and platform securing means to secure the platform at a vertical position adjacent to any one of the roll mounting means. The roll of material is mounted between the spindles. Typically, one of the spindles is spring loaded to facilitate the mounting of the roll material to the spindles. The platform is adjustable vertically relative to the rolls of material and serves as a surface on which the user of the rack can unroll, measure and cut the desired portion of material from the roll of material.

11 Claims, 8 Drawing Sheets

RACK FOR STORING MULTIPLE ROLLS OF MATERIAL AND FOR FACILITATING THE CUTTING OF A PORTION OF MATERIAL FROM THE ROLL

BACKGROUND OF THE INVENTION

The present invention relates generally to devices for storing rolls of material and more particularly to a device for storing rolls of material and for facilitating the cutting of a portion of material from one of the rolls of material.

It will be appreciated by those skilled in the art that in certain industries there is a need for a device that can store multiple rolls of material. Such industries include, but are not limited to, the film making industry and the wallpaper hanging industry. In the film making industry in particular, many different types of material are needed for use in establishing the lighting effects of a particular scene. The particular rolls of material that are used are generally known in the film industry as gels. Typically, these gels are used by the person in charge of lighting to quantifiably and qualitatively exercise control over the color, the diffusion and the intensity of the light that is directed upon a particular scene to be filmed. This control is accomplished by placing the gel material between the light source and the scene. The gel material can be attached to the lighting instrument directly or within a frame that is mounted on the lighting instrument.

Currently, the rolls of gel material are stored in barrels or in piles in a closet, or on shelves on a truck when the scene is being shot at a location. This type of storage makes it difficult to access and to inventory the types of gel material that are available and often results in wasted time and damage to the gel material.

Once a desired gel material is identified, the technician or other worker must cut the desired length and the desired width of the gel material from the roll. Usually, the technician grabs the roll from the barrel or the pile, rolls out the material either on the floor or the ground, measures it as best as he/she can and cuts the measured material from the roll with a hand-held knife. The lack of a cutting surface, particularly a cutting surface including a straight edge, results in inaccurate cuts of material, which can result in the waste of the gel material.

There have been several attempts to solve the problems associated with storing and cutting rolls of material. One such attempt was disclosed in U.S. Pat. No. 5,139,160 issued to Romano on Aug. 18, 1992. This patent discloses a portable knock-down wallpaper holding and cutting rack. The device is capable of supporting two rolls of wallpaper, each of which are supported by a dowel rod. A cutter guide unit is attached to the device below the dowel rods. A length of paper is threaded between the cutter guide panel and support panel of the cutter guide unit and cut off by a worker by a knife. However, the cutter guide unit is not adjustable up or down for placement directly adjacent to the desired roll. Rather, the free end of the wallpaper is drawn through the guide for cutting. Additionally, this rack can only support two rolls of wallpaper and requires a transverse dowel rod to support the rolls of wallpaper. This device is thus limited in its application by these requirements.

Another such attempt was disclosed in U.S. Pat. No. 1,750,582 issued to H. Elliott on Mar. 11, 1930. This patent discloses a device that can support multiple rolls of material. However, the device includes no platform on which to measure and cut material.

What is needed, then, is a device that can store multiple rolls of material and that includes a cutting surface that can be used conveniently and efficiently in removing a desired portion of material from the roll. Such a device is presently lacking in the prior art.

SUMMARY OF THE INVENTION

It is an object of this invention to provide a rack that can store multiple rolls of material.

It is a further object of this invention to provide a rack that includes cutting surface on which a desired portion of material can be cut away and removed from the roll of material.

It is yet another object of this invention to provide a cutting surface that is adjustable relative to the rolls of material so that the cutting surface can be adjacent to the roll of material when the material is unrolled for cutting.

It is yet a further object of the invention to provide a rack that has a trim profile and that can be stored without taking up excess space.

Still another object of this invention is to provide a rack that is portable.

Yet a further object of this invention is to provide a rack that allows efficient loading and unloading of the rolls of material.

Accordingly, a rack for storing rolls of material and for facilitating the removal of a portion of material from the roll is described. The rack comprises a substantially rectangular frame; a plurality of roll mounting means for mounting a plurality of rolls of material horizontally within the frame; and a platform extending horizontally across the frame, the platform mounted to the frame adjacent to one of the roll mounting means.

Preferably, the platform is vertically movable and further comprises platform securing means for securing the platform adjacent to any one of the roll mounting means. Additionally, the preferred platform securing means can be operated by the user with only one hand.

The rack can further comprise at least one axle pivotally mounted on a bottom transverse member of the frame, the axles including wheels mounted at each end of the axle. The roll mounting means can comprise a plurality of paired sets of spindles mounted along vertical members of the frame.

The platform can further comprise measuring indicia mounted on a top surface of the platform. The platform can also comprise accessory mounting means for mounting accessories that facilitate the cutting or measuring of the material, the accessory mounting means mounted on a support section of the platform that extends vertically downward from the top surface of the platform. The accessory mounting means mounted on the support section can comprise a horizontal rod fixedly attached to the support section and a clamp slidably mounted along the rod.

The platform can also comprise an accessory securing means for securing accessories that facilitate cutting or measuring of the material, the accessory securing means mounted on the top surface of the platform. This accessory securing means can comprise a spring loaded flange mounted along an edge of the top surface of the platform, the flange running for the length of the top surface of the platform.

The rack can further comprise roll securing means for securing the rolls of material vertically mounted across the frame such that the rolls of material are between the roll securing means and the platform.

In an alternative embodiment of the rack of this invention, the frame further comprises intermediate vertical members extending into the interior of the frame, the intermediate vertical members attached to the frame at varying distances from vertical members of the frame, the intermediate vertical members also including a plurality of roll mounting means. This alternative embodiment of the invention can accommodate rolls of varying length.

BRIEF DESCRIPTION OF THE DRAWINGS

FIG. 1 is a front elevational view of the rack of this invention.

DESCRIPTION OF THE PREFERRED EMBODIMENT

Figure 1:
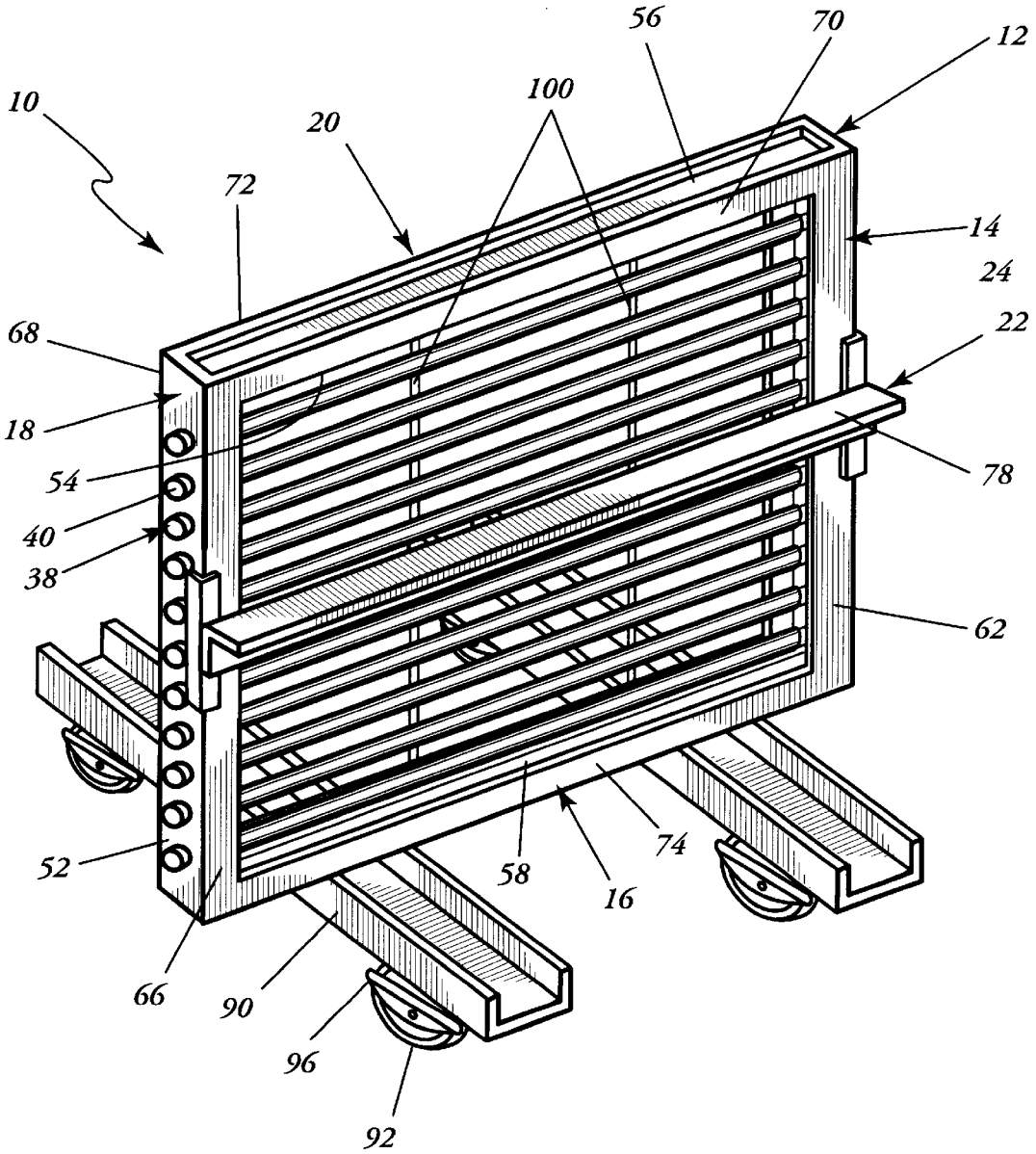
FIG. 1 is a perspective view of the rack of this invention.

A description of the preferred embodiment of the invention will be best understood by referring to FIGS. 1–15 of the accompanying drawings and the parts list wherein like reference numerals refer to like parts. References are made in the detailed description to right and left; bottom and top; interior and exterior; and front and rear. Such references are made for clarity of the written description, and should not be construed as limitations on the scope of this invention.

Referring now to FIGS. 1, 2, 3 and 4, the rack of this invention is referred to generally as 10. Rack 10 comprises frame 12, cutting platform 22, axles 90 and wheels 92. Wheels 92 are common lockable wheels, and thus include wheel mounts 94 and locking mechanism 96.

Frame 12 comprises a right vertical member 14, a bottom transverse member 16, a left vertical member 18, and a top transverse member 20. Right vertical member 14 includes an interior surface 46 that faces the interior of the frame 12; an exterior surface 48 that faces the exterior of frame 12; a front surface 62 that faces the front of frame 12; and a rear surface 64 that faces the rear of the frame 12.

Left vertical member 18 includes an interior surface 50 that faces the interior of the frame 12; an exterior surface 52 that faces the exterior of frame 12; a front surface 66 that faces the front of frame 12; and a rear surface 68 that faces the rear of the frame 12.

Top transverse member 20 includes an interior surface 54 that faces the interior of the frame 12; an exterior surface 56 that faces the exterior of frame 12; a front surface 70 that faces the front of frame 12; and a rear surface 72 that faces the rear of the frame 12.

Bottom transverse member 16 includes an interior surface 58 that faces the interior of the frame 12; an exterior surface 60 that faces the exterior of frame 12; a front surface 74 that faces the front of frame 12; and a rear surface 76 that faces the rear of the frame 12.

Figure 10:
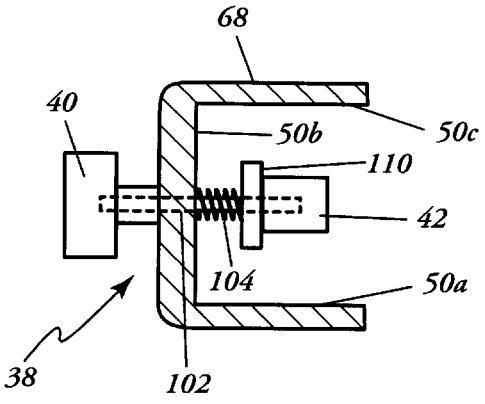
FIG. 10 is a top view detail of the spring loaded spindle assembly taken along the line 10—10 of FIG. 2
Figure 11:
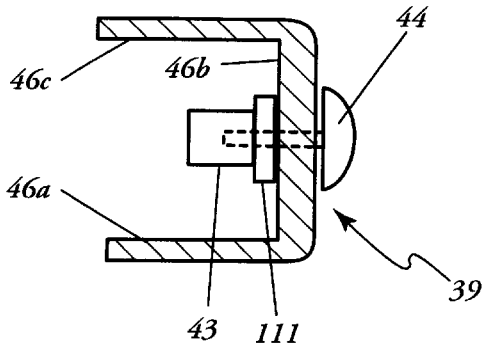
FIG. 11 is a top view detail of the non-spring loaded spindle assembly taken along the line 11—11 in FIG. 2.

Each member 14, 16, 18, 20 of frame 12 is substantially bracket ([ ]) shaped in cross section. Thus, the interior surfaces 46, 50 and 58 of right vertical member 14, left vertical member 18, and bottom transverse member 16, respectively, and the exterior surface 56 of top transverse member 20 can be divided into three sections. The sections include two substantially parallel lateral sections and a medial section between the lateral sections and substantially perpendicular thereto. The sections of the interior surfaces 46, 50 of right and left vertical members 14, 18 are depicted in FIGS. 10 and 11. Two substantially parallel lateral sections 50*a* and 50*c* and 46*a* and 46*c* are connected by medial sections 50*b* and 46*b*.

Figure 6:
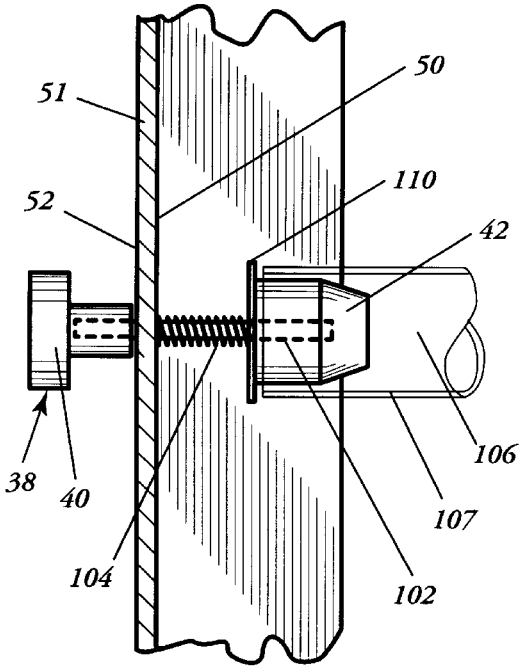
FIG. 6 is a left front detail view of the spring loaded spindle assembly of this invention, showing the roll of material in phantom.
Figure 7:
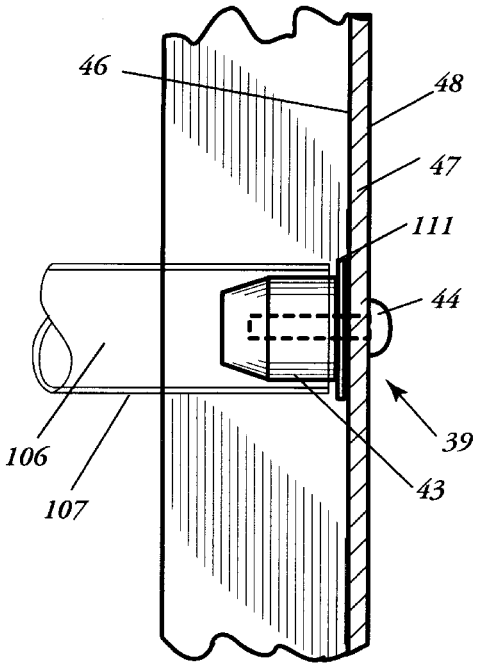
FIG. 7 is a right front detail view of the non-spring loaded spindle assembly of this invention, with the roll of material in phantom, the view being at the opposite end of the roll of material from FIG. 6.

Continuing on FIGS. 10 and 11, and referring also to FIGS. 6 and 7, along the interior surfaces 46, 50 of the vertical members 14, 18 of the frame 12 are a plurality of paired sets of spindles 38, 39 over which will fit the cardboard core 106 that is found within most rolls of material 107. The sets of spindles 38, 39 lie on the same horizontal line and thus serve as means for mounting the rolls of material within frame 12. As more fully described below, one of the spindles in the set, spindle 38, is spring loaded so that it can be compressed when loading the roll of material 107 and then can spring back into the cardboard core 106 when released, thus supporting the roll of material 107 horizontally within the frame 12.

Referring now to FIGS. 6 and 10, the details of the spring loaded spindle 38 are described. Spindle 38 comprises knob 40, support probe 42, and a spindle flange 110. Support probe 42 and spindle flange 110 are preferably formed as a single unit by injection molding. Support probe 42 extends into the core 106 of the roll of material 107 until the core 106 substantially butts against spindle flange 110. In FIGS. 6 and 10, spindle 38 includes connecting pin 102 that passes from a bore in support probe 42 through the medial section 50*b* of interior surface 50 of left vertical member 18 through wall 51 of left vertical member 18 through the exterior surface 52 of left vertical member 18 and into knob 40. A spring 104 is mounted over pin 102 and between wall 51 and spindle flange 110.

Referring now to FIGS. 7 and 11, non-spring loaded spindle 39 is described. Spindle 39 comprises support probe 43 and a spindle flange 111, which are also preferably formed as an integral unit by injection molding. Spindle 39 is mounted on the medial section 46*b* of interior surface 46 of right vertical member 14 using means for mounting such as bolt 44. Bolt 44 passes through the exterior surface 48 of right vertical member 14 through wall 47 of right vertical member 14 through the medial section 46*b* of the interior surface 46 of right vertical member 14 and into support probe 43.

In this embodiment, then, the core 106 is mounted by first fitting the core 106 over spring loaded spindle 38 until core 106 abuts flange 110. The user then presses core 106 against flange 110, moving the entire assembly of spindle 38 to the left and compressing spring 104 between flange 110 and wall 51. The user then fits the other end of core 106 over spindle 39 and releases core 106. Compressed spring 104 expands, thus tightly wedging core 106 between spindles 38 and 39. It is noted that two spring loaded spindles 38 could be used if desired.

Referring now to FIGS. 1, 2, 3 and 4, mounted horizontally on the front surfaces 62, 66 of right and left vertical members 14, 18 of the frame 12 is a vertically movable platform 22 that substantially traverses the width of the frame 12. Platform 22 includes plates 24 which are fixedly mounted to each end 23 of the platform 22. Plates 24 are substantially L-shaped, with a front section lying on the front surfaces 62, 66 of right and left vertical members 14, 18, and a side section lying on the exterior surfaces 48, 52 of right and left vertical members 14, 18. Plates 24 slide along right and left vertical members 14, 18 and function to keep platform 22 perpendicular to vertical members 14, 18.

Figure 14:
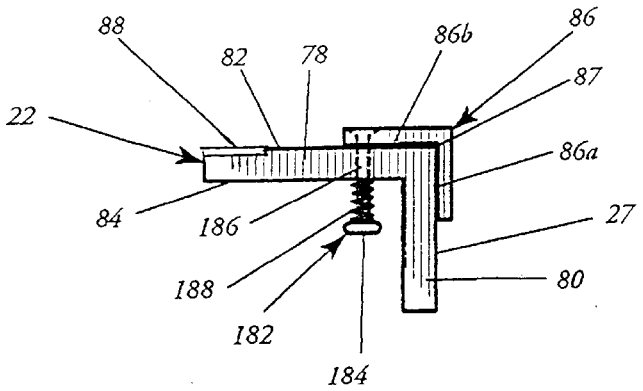
FIG. 14 is a side view detail of the platform.

Continuing on FIGS. 1, 2, 3 and 4, and referring also to FIG. 14, platform 22 is substantially L-shaped, and comprises a tray 78 and a tray support 80 that extends vertically downward from the tray 78. Along a side edge 85 of the top surface 82 of tray 78 is a ruler 88 that can be used to measure the rolled material when it is unrolled so that a user can cut an appropriately sized portion of the material.

Figure 3:
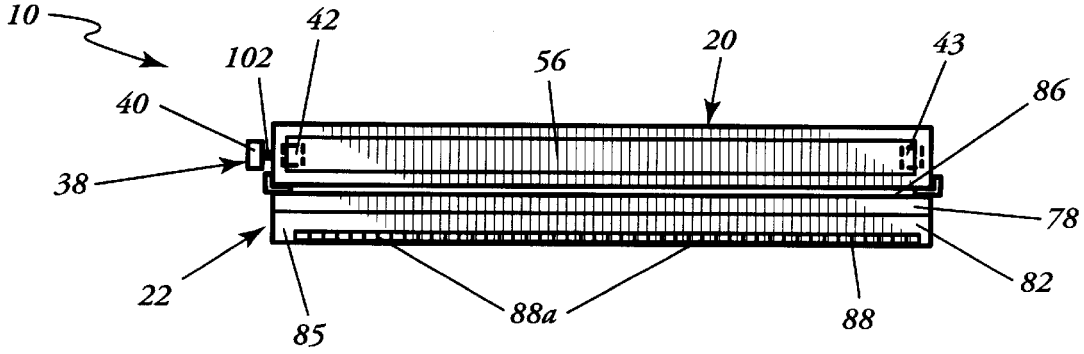
FIG. 3 is a top view of the rack of this invention.
Figure 4:
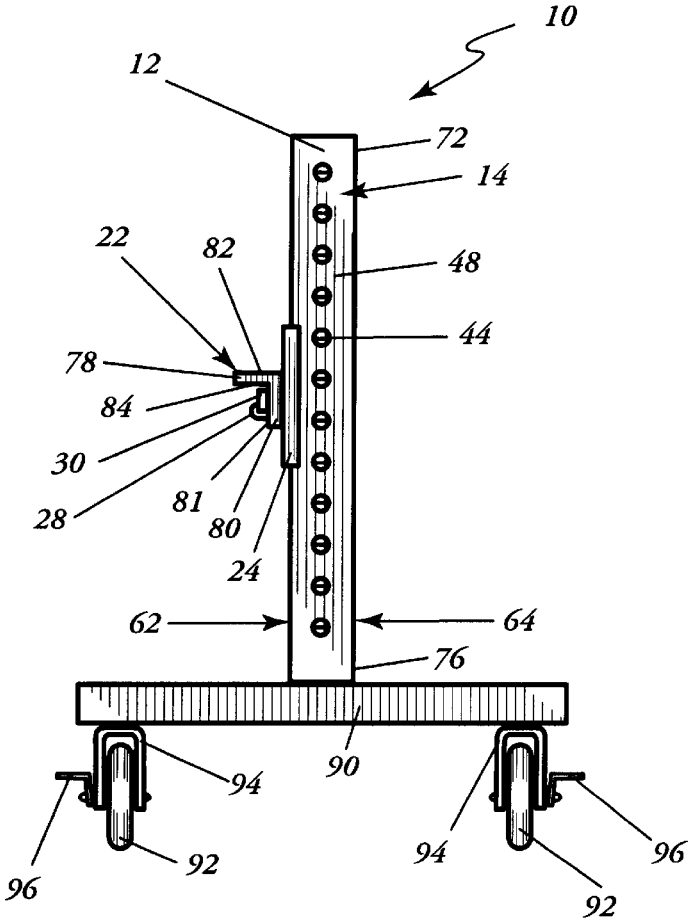
FIG. 4 is a right side view of the rack of this invention.

Continuing on FIGS. 3 and 14, the top surface 82 of the tray 78 has a flange 86 mounted along the side edge 87 opposite the ruler 88. Flange 86 runs for substantially the length of the platform. When the rack 10 is used in the film-making industry, standard gel frames can be mounted between flange 86 and top surface 82 of the tray 78 of platform 22 so that a user can pull the gel material over the gel frame and size the material to the specific size of the gel frame. Thus, flange 86 acts as an accessory mounting means for accessaries that facilitate the measuring and or cutting of material from the roll.

Continuing on FIG. 14, flange 86 is substantially L-shaped, and the vertical back section 86*a* of flange is slidably mounted to the rear surface 27 of tray support 80. Flange 86 is preferably mounted with the horizontal front section 86*b* of flange 86 resting against the top surface 82 of tray 78 of platform 22. As best seen in FIG. 14, a pin 182 passes through a bore in tray 78 and is fixedly attached to horizontal front section 86*b*. The pin 182 includes a head member 184 and a shank 186. The shank 186 passes through tray 78 and is fixedly attached to horizontal front section 86*b*. A spring 188 is mounted between bottom surface 84 of tray 78 and the head member 184 of the pin 182. The spring 188 biases head member 184 away from tray 78, which in turn, secures horizontal front section 86*b* against the top surface 82 of tray 78.

The user operates the flange 86 by pushing up on head member 184, which raises horizontal front section 86*b*. Vertical back section 86*a* also slides upwards. The user then places the desired accessory between horizontal front section 86*b* and top surface 82 of tray 78. The user then releases head member 184 and spring 188 propels head member away from tray 78, thus securing the accessory between horizontal front section 86*b* and top surface 82 of tray 78. By using spring 188 in mounting flange 86 to platform 22, the process of lifting flange 86, placing the desired accessory between flange 86 and platform 22, and releasing flange 86 so that flange 86 securely holds the accessory in place is simplified.

Figure 13:
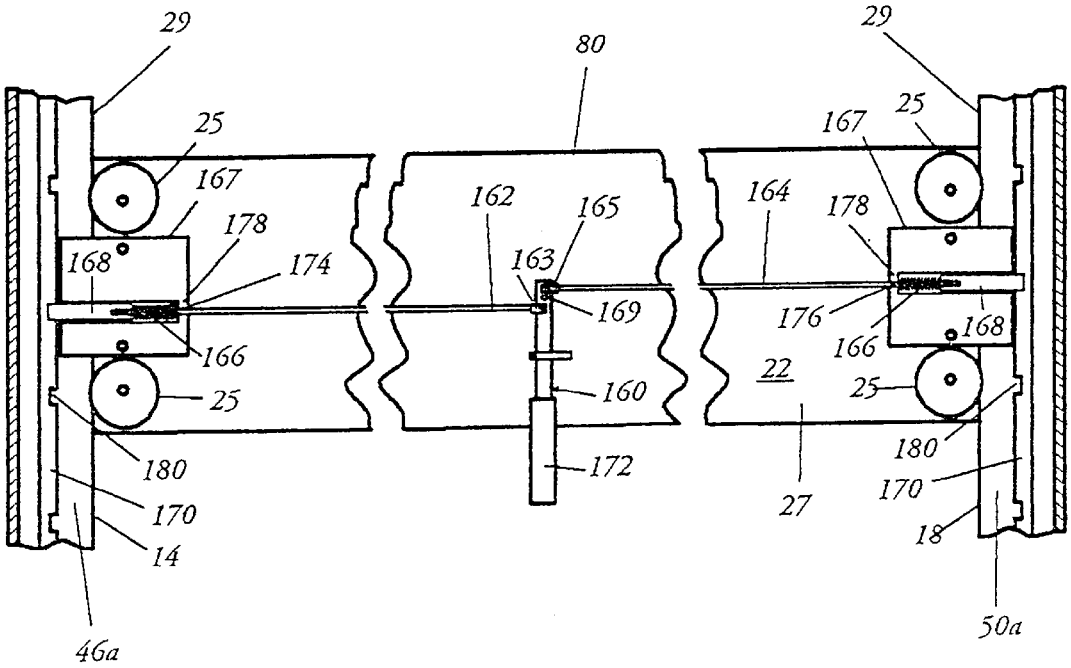
FIG. 13 is a partial rear view of platform showing the preferred platform securing means assembly.

Referring now to FIG. 13, platform 22 includes wheels 25 or the like on the rear surface 27 of tray support 80. Wheels 25 roll along the edges 29 of lateral sections 46*a* and 50*a* of interior surfaces 46, 50 of right and left vertical members 14, 18 and thus facilitate the movement of the platform 22 along vertical members 14, 18. As more fully described below, the platform 22 can be secured at a position along the height of the frame 12 that is adjacent to a desired roll of material.

Continuing on FIG. 13, the preferred platform securing means are described in detail. Rack 10 includes securing means for securing the platform at a vertical position along rack 10 that can be manipulated by the user using only one hand. The platform securing means includes lever 160, rods 162 and 164, springs 166, blocks 167, pins 168 and notch strips 170. Lever 160 is pivotally attached to the rear surface 27 of tray support 80 at pivot point 169. Lever 160 includes a handle 172 at its end opposite the end of lever 160 where lever 160 is mounted to the rear surface 27 of tray support 80. Inner or proximal ends 163 and 165 of rods 162 and 164 are attached to lever 160 adjacent to pivot point 169. Outer or distal ends 174 and 176 of rods 162 and 164 pass through wall 178 of block 167 through spring 166 and to a first end of pin 168. Pin 168 is larger in diameter than rod 162 and 164. Spring 166 is also attached to the first end of pin 168. Thus, spring 166 is mounted between wall 178 and pin 168 and within block 167. Spring 166 is biased to propel pin 168 into notch 180 and is preferably a helical compression spring. Block 167 is preferably plastic to reduce lubrication requirements.

Continuing on FIG. 13, along the front lateral sections 46*a* and 50*a* of interior surfaces 46 and 50 of right and left vertical members 14 and 18 are mounted notch strips 170. Notch strips 170 include a plurality of notches 180. Notches 180 are the same distance apart as spindles 38, 39 and are located halfway between spindles 38, 39. This enables the user to position the platform 22 adjacent to the desired roll of material. The end of pin 168 opposite spring 166 rests within notch 180 of notch strip 170. Thus, pin 168 secures platform 22 in the desired vertical position along frame 12.

When the user wants to raise or lower the platform 22, he moves the lever 160 laterally. Bars 162 and 164 move towards the center of platform 22. Pins 168 are moved out of notches 180 and against springs 166. While pins 168 are out of notches 180, the user moves the platform 22 to the desired position. The user then releases lever 160, and springs 166 propel pins 168 back into notches 180 proximate to the desired position.

Although not shown in the drawings, an alternative means for securing platform 22 comprises retractable or quick release spring-loaded plungers, as are commonly available from many sources. One such source is Vlier Products, 2333 Valley Street, Burbank, Calif. 91505, part nos. SL-190, SL-250, SL-312, SL-375, or SL-500. These plungers can be mounted at each end 23 of platform 22 such that each plunger passes through the platform 22 and interacts with a hole in the front surfaces 62, 66 of right and left vertical members 14, 18. These holes are the same distance apart as spindles 38, 39 and are located halfway between spindles 38, 39. The user moves platform 22 into a position adjacent to the desired roll of material by pulling out on the plungers and manually lifting or lowering the platform 22. The platform 22 is then secured by the release of the plungers and the propulsion of the plunger by the spring in the plunger into platform securing holes formed in the front surfaces 62, 66 of right and left vertical members 14, 18.

Referring now to FIGS. 2, 8, 9 and 15, a bar 28 is horizontally mounted on the front surface 81 of tray support 80 of platform 22. Bar 28 is attached to tray support 80 using bar attaching posts 30, 32. Bar attaching posts 30, 32 are fixedly attached to tray support 80 and a bolt 112 passes through posts 30, 32 and into bar 28.

Figure 8:
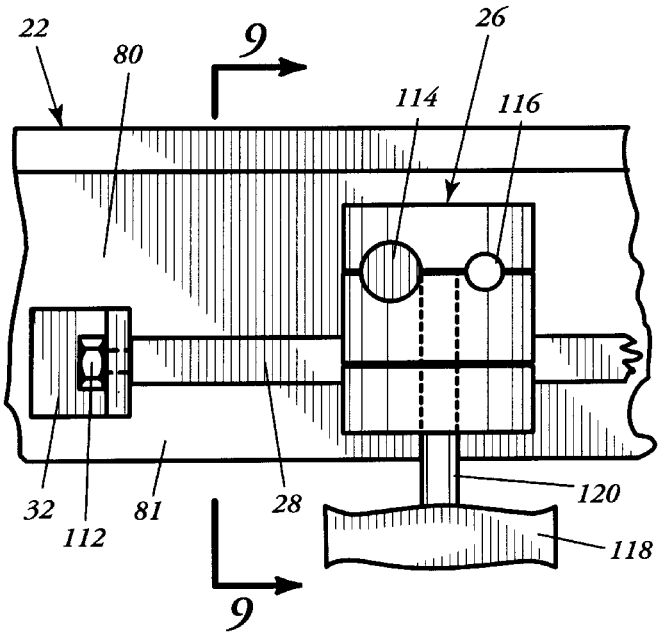
FIG. 8 is a front detail view of the adaptor clamp assembly included within this invention.
Figure 9:
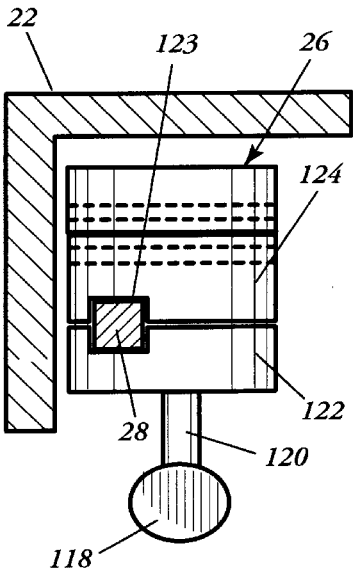
FIG. 9 is a sectional view of the adaptor clamp assembly included within this invention taken along the line 9—9 in FIG. 8.

An adaptor clamp 26 is slidably mounted along bar 28. As best seen in FIGS. 8 and 9, adaptor clamp 26 includes a first clamp hole 114 and a second clamp hole 116 into which can fit a variety of different accessories. Thus, clamp 26 acts as a means for mounting accessories to the platform 22 that facilitate measuring or sizing the material.

Clamp 26 further includes clamp handle 118 and clamp handle support 120. Clamp 26 is slidably mounted on bar 28 in that bar 28 passes through bore 123 in clamp 26. Clamp 26 includes three parts, lower clamp 122, medial clamp 124, and upper clamp 126. As best seen in FIG. 8, clamp handle support 120 passes through and is operatively connected with each part of clamp 26. Clamp handle 118 is turned to secure lower clamp 122 and medial clamp 124 together, thus securing clamp 26 to bar 28. Clamp handle 118 is also turned to secure medial clamp 124 and upper clamp 126 together, thus securing accessories within clamp 26. Clamp 26 is thus double acting.

Figure 15:
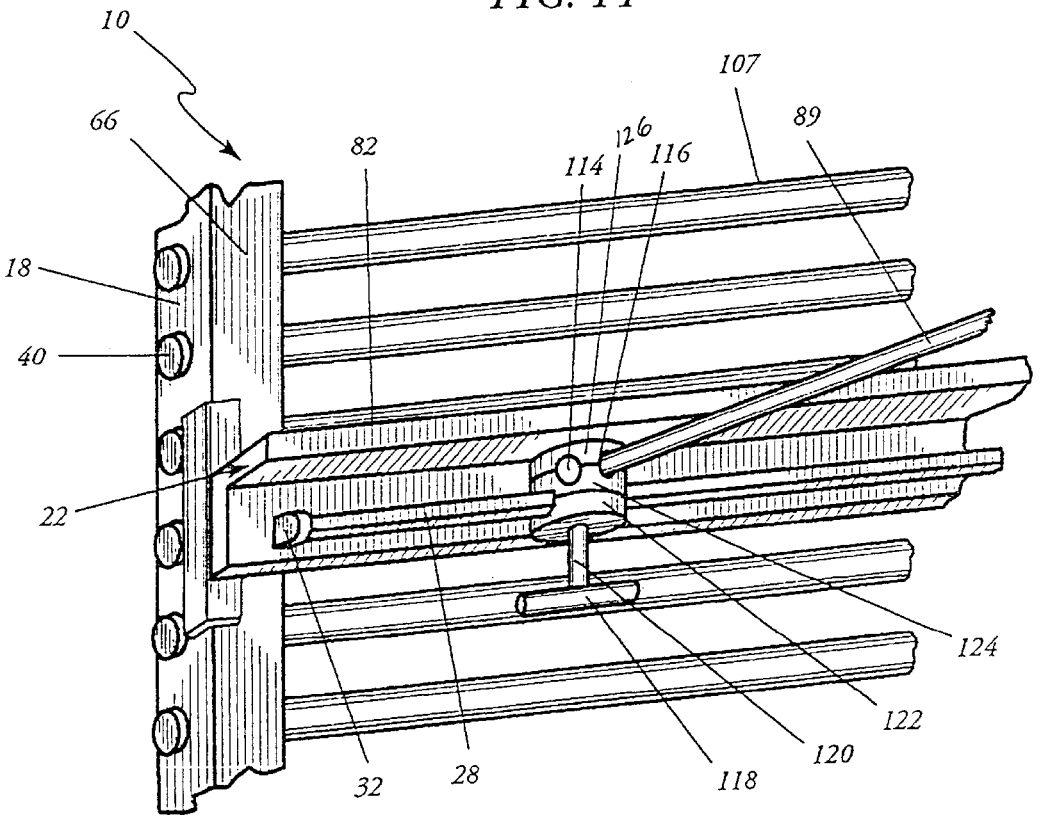
FIG. 15 is a broken away perspective view of the rack showing accessories for the platform.

As best seen in FIG. 15, another ruler 89 can be mounted in holes 114 or 116 of clamp 26 at a 90° angle with the tray 78 of platform 22 to facilitate measuring and cutting the material. Another specific use for clamp 26 is the mounting of standard size gel frames that are common in the film industry.

Figure 12:
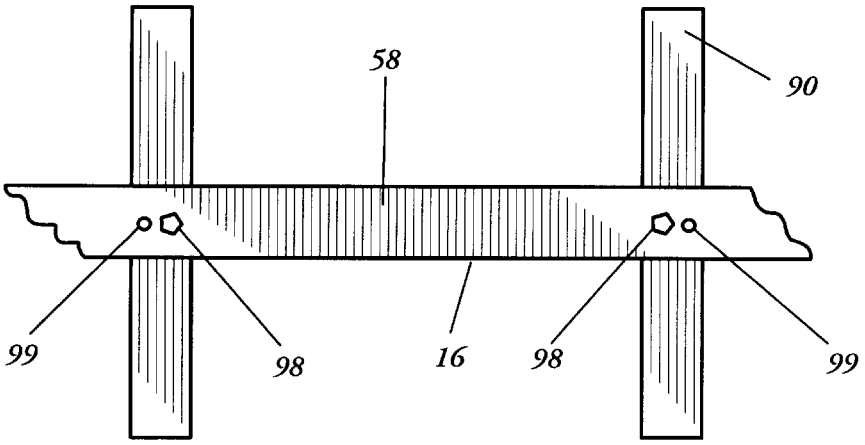
FIG. 12 is a partial view of the axles and bottom transverse member of the frame showing how the axles are mounted to the bottom transverse member of the frame.
Figure 12A:
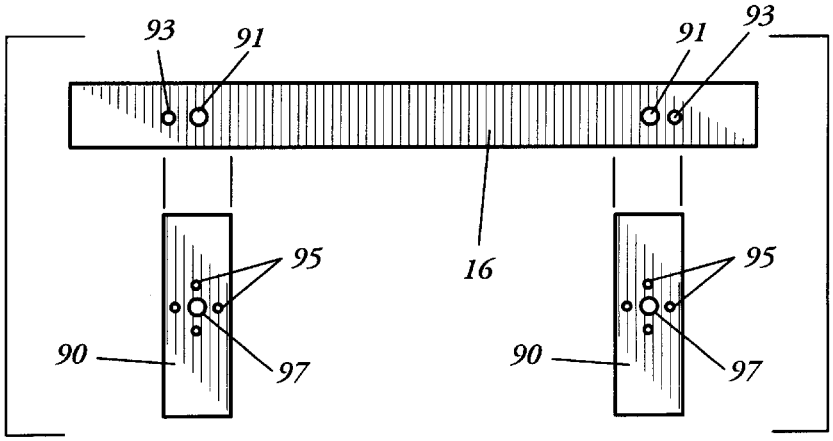
FIG. 12*a* is an exploded partial view of the axles and bottom transverse member of the frame showing bore holes in relation to the bottom transverse member of the frame.

Referring now to FIGS. 2, 4, 12 and 12*a*, two axles 90 with lockable wheels 92 are mounted on the bottom transverse member 16 of the frame 12. These axles 90 can pivot on their center mounting bolt 98 and can be locked into a position either perpendicular to or in line with the frame 12 using pins 99. As best seen in FIGS. 12 and 12*a*, a set of four bores 95 form a diamond pattern around a central bore 97 in axles 90. Large bore 91 and small bore 93 are made in bottom transverse member 16. Large and small bores 91, 93 lie on the same line and are the same distance apart as central bore 97 and one of bores 95. Center mounting bolt 98 passes through large bore 91 and central bore 97, thus securing axles 90 to bottom transverse member 16. Axles 90 are locked into the desired position by sliding pin 99 through small bore 93 and into bores 95. The diamond pattern of bores 95 thus allows the user to pivot the axles 90 in either direction when changing axle positions, providing another convenient feature of the rack 10.

Figure 2:
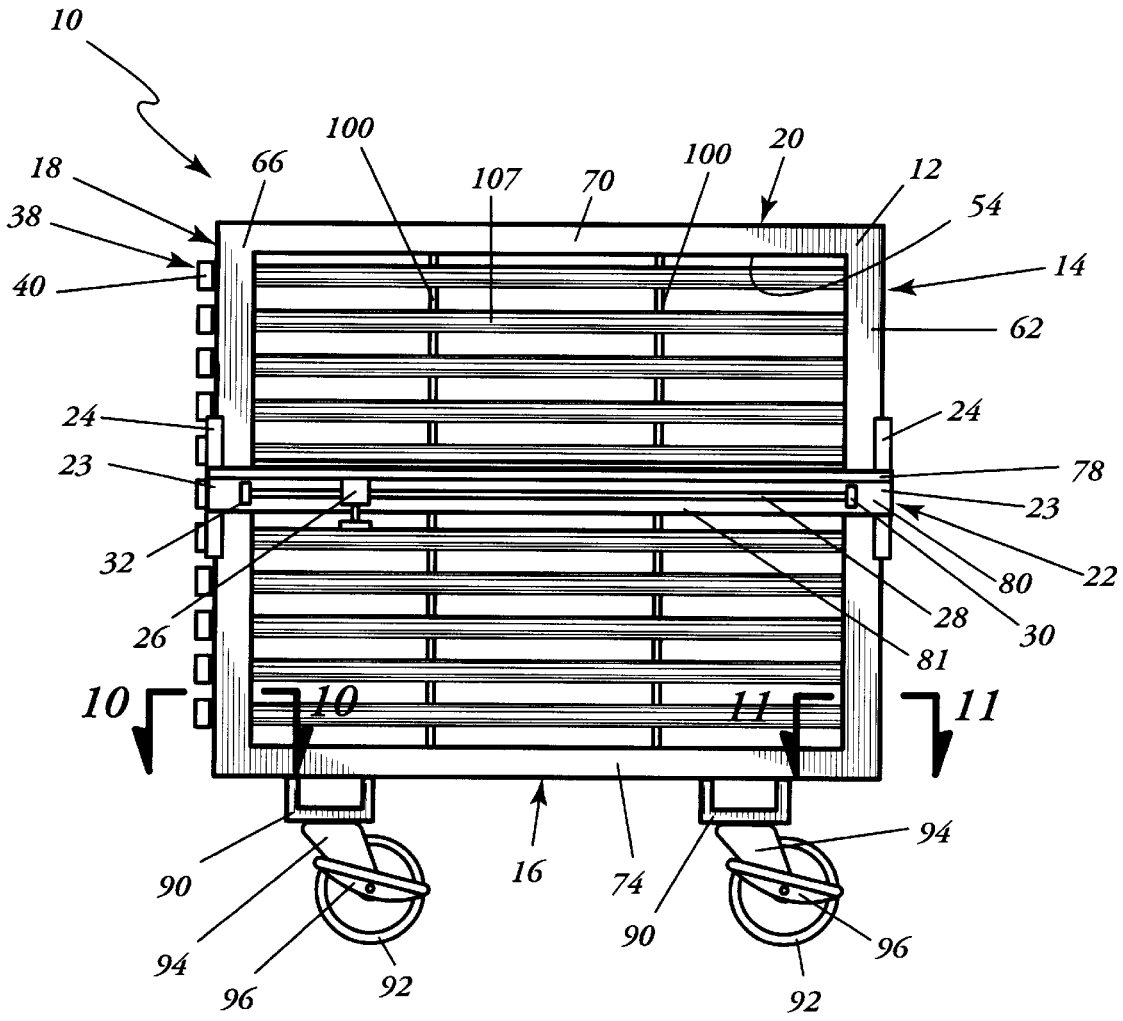

Continuing on FIG. 2, the rack 10 has roll securing rigid straps 100 that run behind the platform 22. Rigid straps 100 have a friction producing means, such as a foam pad, mounted to the side of the strap 100 that faces the rolls. These straps 100 are used to secure the rolled material so that it does not unroll. Thus, the straps 100 act as roll securing means. Other examples of roll securing means include, but are not limited to, elastic cords.

Rack 10 is used as follows. The user of rack 10 first moves platform 22 vertically into a position adjacent to the desired roll of material. The user then pulls the material from the roll and over the top surface 82 of tray 78 of platform 22. The user then measures the desired width and length of the material using rulers 88 and 89. The user then removes the sized material with a hand-held knife. The material can then be re-rolled onto the roll using knob 40. This can be done by manually turning knob 40. Alternatively, knob 40 can be fitted with a hand operated crank or with a hexagonal-headed bolt which is adapted to fit any standard drill bit or other power accessory. The user can then apply the crank to the knob 40 or can apply the drill to the hexagonal-headed bolt to facilitate winding and unwinding of the rolled material.

Figure 5:
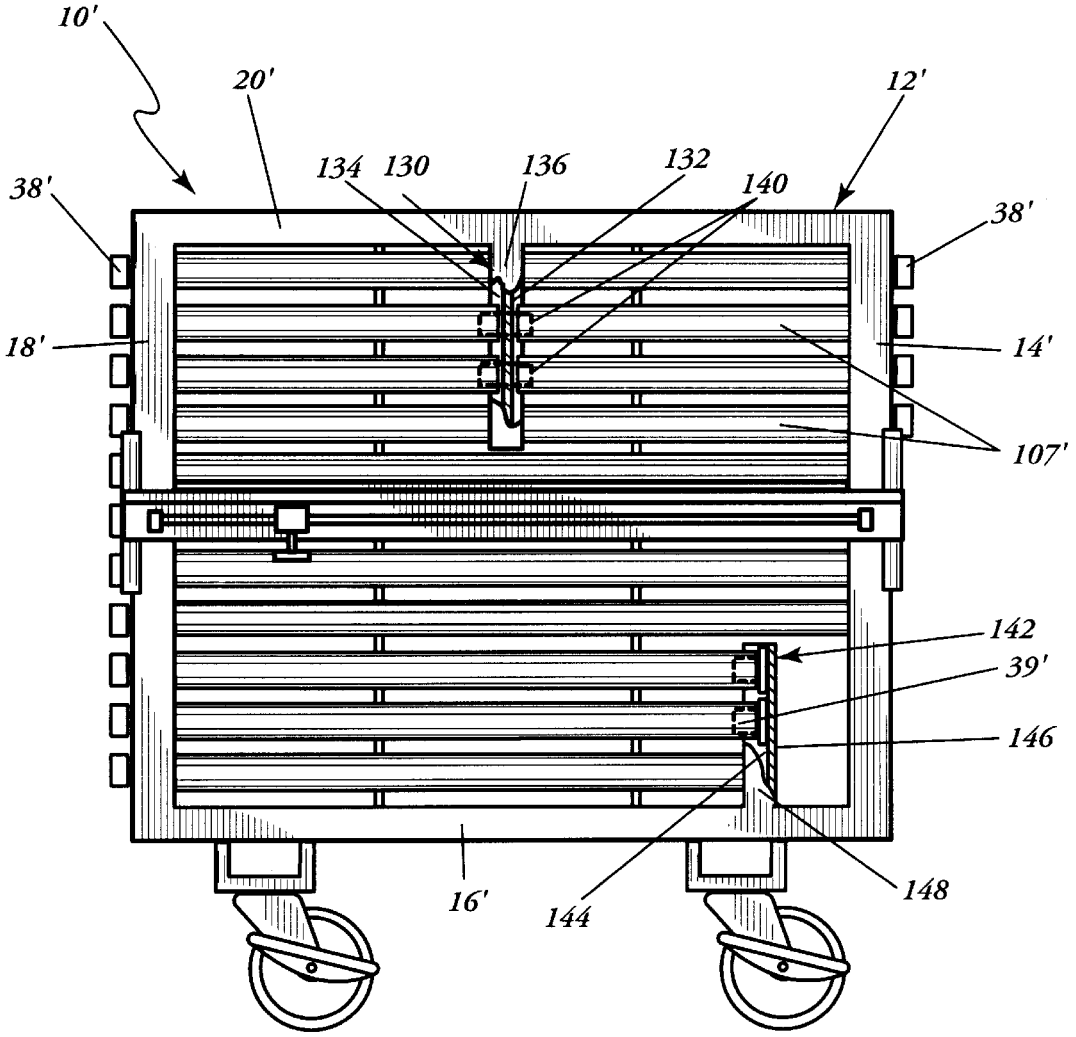
FIG 5 is a front elevational view of an alternative embodiment of this invention.

Referring now to FIG. 5, an alternative embodiment of the rack 10' is depicted. Alternative embodiment 10' is designed to store rolls of material of varying lengths. Medial vertical member 130 extends vertically downward from top transverse member 20' of frame 12'. Medial vertical member 130 is located approximately in the middle of top transverse member 20'. Medial vertical member 130 includes right interior surface 132; left interior surface 134; front surface 136; and rear surface 138.

A two-probed spindle 140 is mounted within medial vertical member 130 such that each of its probes extends outward from the right interior surface 132 and the left interior surface 134 of medial vertical member 130. Each of these probes 140 fits into one end of the roll 107'. Spring loaded spindles 38' are mounted into right vertical member 14' and left vertical member 18' as described above. One end of roll 107' is mounted onto spring loaded spindle 38' first, also as described above. Then the opposite end of roll 107' is fitted over two-probed spindle 140.

Continuing on FIG. 5, intermediate vertical support member 142 is also depicted. Intermediate vertical support member 142 extends vertically upward from bottom transverse member 16' at a point closer to right vertical member 14' than left vertical member 18'. Thus, rolls 107' of material of an intermediate length can be mounted to the rack 10'.

Intermediate vertical support 142 includes left interior surface 144; right interior surface 146; and front surface 148. Spindles 39' are mounted to intermediate vertical support through left interior surface 144 and right interior surface 146 in substantially the same manner as spindles 39 are mounted, as described above in FIG. 7. Rolls 107' of intermediate length are mounted to the rack in substantially the same manner as is described above.

It is also contemplated that medial vertical member 130 could extend across the entire frame 12. Thus, in this additional alternative embodiment, rack 10 would hold only rolls of material of a shorter length.

Rack 10 is preferably made of a light-weight material such as aluminum. This allows rack 10 to be moved easily on wheels 92. Additionally, rack 10 has a trim profile which enables rack 10 to be conveniently stored.

Parts List 10,10' Rack, Alternative Embodiment of Rack 12,12' Frame, Frame of Alternative Embodiment 10'

14,14' Right Vertical Member of Frame, Right Vertical Member of Frame of Alternative Embodiment 10'

16,16' Bottom Transverse Member of Frame, Bottom Transverse Member of Frame of Alternative Embodiment 10'

18,18' Left Vertical Member of Frame, Left Vertical Member of Frame of Alternative Embodiment 10'

20,20' Top Transverse Member of Frame, Top Transverse Member of Frame of Alternative Embodiment 10'

22 Platform

24 Plate

25 Wheels

26 Clamp

27 Rear Surface of Tray Support 80

28 Bar for supporting the Clamp

29 Edges of Lateral Sections 46*a* and 50*a* of Interior Surfaces 46 and 50

30 Right Bar Attachment Post

32 Left Bar Attachment Post

38,38' Spring Loaded Spindle, Spring loaded Spindle of Alternative Embodiment 10'

39,39' Non-spring Loaded Spindle, non-spring loaded Spindle of Alternative Embodiment 10'

40 Spindle Knob

42 Spindle Support Probe

43 Support Probe of Non-spring Loaded Spindle

44 Bolt

46 Interior Surface of Right Vertical Member of Frame

46*a* Lateral Section of Interior Surface of Right Vertical Member

46*b* Medial Section of Interior Surface of Right Vertical Member

46*c* Lateral Section of Interior Surface of Right Vertical Member

47 Wall of Right Vertical Member

48 Exterior Surface of Right Vertical Member of Frame

50 Interior Surface of Left Vertical Member of Frame

50*a* Lateral Section of Interior Surface of Left Vertical Member

50*b* Medial Section of Interior Surface of Left Vertical Member

50*c* Lateral Section of Interior Surface of Left Vertical Member

51 Wall of Left Vertical Member

52 Exterior Surface of Left Vertical Member of Frame

54 Internal Surface of the Top Transverse Member of Frame

56 Exterior Surface of the Top Transverse Member of Frame

58 Interior Surface of the Bottom Transverse Member of Frame

60 Exterior Surface of the Bottom Transverse Member of Frame

62 Front Surface of the Right Vertical Member

64 Rear Surface of the Right Vertical Member

66 Front Surface of the Left Vertical Member

68 Rear Surface of the Left Vertical Member

70 Front Surface of the Top Transverse Member

72 Rear Surface of the Top Transverse Member

74 Front Surface of the Bottom Transverse Member

76 Rear Surface of the Bottom Transverse Member

78 Tray of the Platform

80 Tray Support

81 Front Surface of the Tray Support

82 Top Surface of the Tray

84 Bottom Surface of Tray

85 Side Edge of Top Surface of Tray where Ruler 88 is mounted

86 Flange

86*a* Vertical Back Section of Flange

86*b* Horizontal Front Section of Flange

87 Side Edge of Top Surface of Tray

88 Ruler

89 Accessory Ruler

90 Axle

91 Large Bore

92 Wheel

93 Small Bore

94 Wheel Mount

95 Bore included within diamond pattern

96 Wheel Locking Mechanism

97 Central bore

98 Center Mounting Bolt of the Axle

99 Pin

100 Roll Securing Cord

102 Spindle Connecting Pin

104 Spring

106 Cardboard Cord of the Roll of Material

107,107' Roll of Material, Roll of Material of Alternative Embodiment 10'

110 Spindle Flange

111 Spindle Flange of Non-spring Loaded Spindle

112 Bar Securing Bolt

114 Clamp Hole #1

116 Clamp Hole #2

118 Clamp Handle

120 Clamp Handle Support

122 Lower Clamp

123 Bore in Clamp that accepts bar 28

124 Medial Clamp

126 Upper Clamp

130 Medial Vertical Member of Alternative Embodiment 10' of Rack

132 Right Interior Surface of Medial Vertical Member

134 Left Interior Surface of Medial Vertical Member

136 Front Surface of Medial Vertical Member

138 Rear Surface of Medial Vertical Member

140 Two Probed Spindle

142 Intermediate Vertical Support Member of Alternative Embodiment 10' of Rack

144 Left Interior Surface of Intermediate Vertical Support

146 Right Interior Surface of Intermediate Vertical Support

148 Front Surface of Intermediate Vertical Support

160 Lever

162 Rods

163 Inner or Proximal End of Rod 162

164 Rods

165 Inner or Proximal End of Rod 164

166 Spring

167 Block

168 Pin

169 Pivot Point

170 Notch Strip

172 Handle of Lever

174 Outer or Distal End of Rod 162

176 Outer or Distal End of Rod 164

178 Wall of Block 167

180 Notches

182 Flange Pin

184 Head member of Flange pin

186 Shank of Flange pin

188 Spring

Thus, although there have been described particular embodiments of the present invention of a new and useful rack for storing multiple rolls of material and for facilitating the cutting of a portion of material from the roll, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A rack for storing rolls of material and for facilitating the removal of a portion of material from the roll, the rack comprising:

a. a substantially rectangular frame;

b. a plurality of roll mounting means for mounting a plurality of rolls of material horizontally within the frame:

c. a platform extending horizontally across the frame, wherein the platform is mounted for vertical movement along the frame relative to the roll mounting means and further comprises platform securing means for securing the platform adjacent to any one of the roll mounting means; and d. the platform further comprises measuring indicia mounted on a top surface of the platform.

2. A rack for storing rolls of material and for facilitating the removal of a portion of material from the roll, the rack comprising:

a. a substantially rectangular frame;

b. a plurality of roll mounting means for mounting a plurality of rolls of material horizontally within the frame;

c. a platform extending horizontally across the frame, wherein the platform is mounted for vertical movement along the frame relative to the roll mounting means and further comprises platform securing means for securing the platform adjacent to any one of the roll mounting means;

d. the platform further comprises accessory mounting means for mounting accessories that facilitate the cutting or measuring of the material, the accessory securing means mounted on a top surface support section of the platform that extends vertically downward from the top surface of the platform; and e. the accessory securing means mounted on the support section comprises a horizontal rod fixedly attached to the support section and a clamp slidably mounted along the rod.

3. A rack for storing rolls of material and for facilitating the removal of a portion of material from the roll, the rack comprising:

a. a substantially rectangular frame;

b. a plurality of roll mounting means for mounting a plurality of rolls of material horizontally within the frame;

c. a platform extending horizontally across the frame, wherein the platform is mounted for vertical movement along the frame relative to the roll mounting means and further comprises platform securing means for securing the platform adjacent to any one of the roll mounting means; and d. the platform further comprises an accessory securing means for securing accessories that facilitate cutting or measuring of the material, the accessory securing means mounted on a top surface of the platform.

4. The rack according to claim 3 wherein the accessory securing means comprises a spring loaded flange mounting along an edge of the top surface of the platform, the flange running for the length of the top surface of the platform.

5. A rack for storing rolls of material and for facilitating the removal of a portion of material from the roll, the rack comprising:

a. a substantially rectangular frame;

b. a plurality of roll mounting means for mounting a plurality of rolls of material horizontally within the frame; and c. a platform extending horizontally across the frame, wherein the platform is mounted for vertical movement along the frame relative to the roll mounting means and further comprises platform securing means for securing the platform adjacent to any one of the roll mounting means, and wherein the platform securing means can be operated by a user with only one hand.

6. A rack for storing rolls of material and for facilitating the removal of a portion of material from the roll, the rack comprising:

a. a substantially rectangular frame comprising a top transverse member, a pair of substantially parallel vertical members, and a bottom transverse member;

b. a plurality of roll mounting means for mounting a plurality of rolls of material horizontally within the frame;

c. a platform extending horizontally between the vertical members, the platform mounted between the vertical members for vertical movement, relative to the roll mounting means, between the vertical members;

d. platform securing means to secure the platform at a vertical position adjacent to any one of the roll mounting means; and e. wherein the platform further comprises measuring indicia mounted on a top surface of the platform.

7. A rack for storing rolls of material and for facilitating the removal of a portion of material from the roll, the rack comprising:

a. a substantially rectangular frame comprising a top transverse member, a pair of substantially parallel vertical members, and a bottom transverse member:

b. a plurality of roll mounting means for mounting a plurality of rolls of material horizontally within the frame;

c. a platform extending horizontally between the vertical members, the platform mounted between the vertical members for vertical movement, relative to the roll mounting means, between the vertical members;

d. platform securing means to secure the platform at a vertical position adjacent to any one of the roll mounting means; and e. wherein the platform further comprises accessory mounting means for mounting accessories that facilitate the cutting or measuring of the material, the accessory securing means mounted on a support section of the platform that extends vertically downward from a top surface of the platform.

8. The rack according to claim 7 wherein the accessory securing means mounted on the top surface support section comprises a horizontal rod fixedly attached to the top surface support section and a clamp slidably mounted along the rod.

9. A rack for storing rolls of material and for facilitating the removal of a portion of material from the roll, the rack comprising:

a. a substantially rectangular frame comprising a top transverse member, a pair of substantially parallel vertical members, and a bottom transverse member;

b. a plurality of roll mounting means for mounting a plurality of rolls of material horizontally within the frame;

c. a platform extending horizontally between the vertical members, the platform mounted between the vertical members for vertical movement, relative to the roll mounting means, between the vertical members;

d. platform securing means to secure the platform at a vertical position adjacent to any one of the roll mounting means; and e. wherein the platform further comprises an accessory securing means for securing accessories that facilitate cutting or measuring of the material, the accessory securing means mounted on a top surface of the platform.

10. The rack according to claim 9 wherein the accessory securing means comprises a spring loaded flange mounting along an edge of the top surface of the platform, the flange running for the length of the top surface of the platform.

11. A rack for storing rolls of material and for facilitating the removal of a portion of material from the roll, the rack comprising:

a. a substantially rectangular frame comprising a top transverse member, a pair of substantially parallel vertical members, and a bottom transverse member;

b. a plurality of roll mounting means for mounting a plurality of rolls of material horizontally within the frame;

c. a platform extending horizontally between the vertical members, the platform mounted to the vertical members for vertical movement, relative to the roll mounting means, along between the vertical members; and d. platform securing means to secure the platform at a vertical position adjacent to any one of the roll mounting means, wherein the platform securing means can be operated by the user with only one hand.

* * * * *